US006494688B1

(12) United States Patent
Barito et al.

(10) Patent No.: US 6,494,688 B1
(45) Date of Patent: Dec. 17, 2002

(54) FORCE-FIT SCROLL COMPRESSOR COMPONENTS

(75) Inventors: Thomas R. Barito, Arkadelphia, AR (US); Frederick L. Phillips, Arkadelphia, AR (US); Zili Sun, Arkadelphia, AR (US); Jay Andrew Herbert, Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/353,848

(22) Filed: Jul. 15, 1999

(51) Int. Cl.[7] ..... F04B 49/00
(52) U.S. Cl. ..... 417/310; 417/410.5; 418/55.1
(58) Field of Search ..... 417/310, 410.5, 417/559; 418/55.1

(56) References Cited

U.S. PATENT DOCUMENTS 3,589,386 A * 6/1971 Chapman ..... 137/269
5,051,079 A * 9/1991 Richardson, Jr. ..... 418/55.2
5,173,042 A * 12/1992 Chambers ..... 418/55
5,342,183 A * 8/1994 Rafalovich et al. ..... 418/55.1
5,503,542 A * 4/1996 Grassbaugh et al. ..... 418/55.1
5,683,236 A * 11/1997 Harrison et al. ..... 418/55.1
6,086,342 A * 7/2000 Utter ..... 418/55.5
6,203,298 B1 * 3/2001 Scarfone et al. ..... 418/55.1

FOREIGN PATENT DOCUMENTS

JP 4-241702 A * 8/1992 ..... 418/55.1
JP 8-303360 A * 11/1996 ..... 418/55.1

* cited by examiner

*Primary Examiner*—Cheryl J. Tyler
(74) *Attorney, Agent, or Firm*—Carlson, Gaskey & Olds

(57) ABSTRACT

A scroll compressor includes a plurality of components which are force-fit together. The components include the separator plate, a pressure relief valve mounted in the separator plate, and a discharge tube. By force-fitting these components, the necessity of welding operations in the interior of the scroll member is eliminated. This will reduce the occurrence of weld splatter, which is undesirable. Further, the assembly of the scroll compressor is simplified by this invention.

8 Claims, 2 Drawing Sheets

FORCE-FIT SCROLL COMPRESSOR COMPONENTS

BACKGROUND OF THE INVENTION

This invention relates to a simplified method of forming a scroll compressor.

Scroll compressors are becoming widely utilized in refrigerant compression applications. A scroll compressor includes a pair of scroll elements, each having a base and a generally spiral wrap extending from the base. The spiral wraps interfit to define compression chambers. One of the scroll members is caused to orbit relative to the other. A motor drives a shaft to cause the scroll member to orbit.

The motor and scroll unit are enclosed in a sealed housing. Within the housing there is a separator plate which separates a chamber at suction pressure, and another chamber at discharge pressure. A pressure relief valve within the separator plate is typically mounted to selectively communicate gas in the discharge pressure chamber to the suction pressure chamber. Further, the separator plate mounts a discharge tube and check valve. The compressor housing is typically closed by an end cap which is welded to the center shell. In the past, the separator plate has been welded to the end cap. Further, the pressure relief valve has been threaded into the separator plate, or, in at least one proposed compressor, resistance welded. Further, the discharge tube and check valve have typically been welded into the separator plate.

It is undesirable to perform welding operations in the vicinity of the separator plate. Weld splatter could enter into the compressor environment, and be found within the sealed housing in some percentage of the compressors having welded components.

Further, the use of a threaded pressure relief valve raises the requirement of expensive parts and complex tooling.

It is a goal of this invention to reduce the complexity of assembly of the scroll compressors. Further, while the invention is disclosed with reference to a scroll compressor, there may be application in other types of sealed compressors.

SUMMARY OF THE INVENTION

In a disclosed embodiment of this invention, the separator plate is interference fit into the end cap. In embodiments of this aspect, the separator plate may have an outer diameter which is greater than the inner diameter of the end cap. The difference in the diameters may be sufficient such that when the separator plate is forced into the end cap, it is fixed in place. In an alternative embodiment, the difference is less than this first embodiment. The second embodiment separator plate is sized to be larger than the inner diameter of the end cap for a sufficient amount that a fluid tight seal is provided at the connection, however, the separator plate may be still be moveable axially. In this embodiment, it is preferred that the separator plate rests upon a surface of the center shell to properly position and support the separator plate. Thus, the separator plate is not welded to the end cap, and no weld splatter occurs.

Further, the pressure release valve is preferably interference fit into the separator plate. In this way, no complex machining or welding need occur.

In further preferred features, the discharge tube and check valve are also interference fit within the separator plate. In this way, a subassembly of the end cap, separator plate, pressure relief valve and discharge tube may be all assembled and the entire subassembly then mounted to the scroll compressor and center shell. Since there is no welding, the present invention reduces problems with the prior art, and further reduces the complexity of forming the compressor over the prior art.

These and other features of the present invention can be best understood from the following specification and drawings, the following of which is a brief description.

DETAILED DESCRIPTION OF A PREFERRED EMBODIMENT

Figure 1:
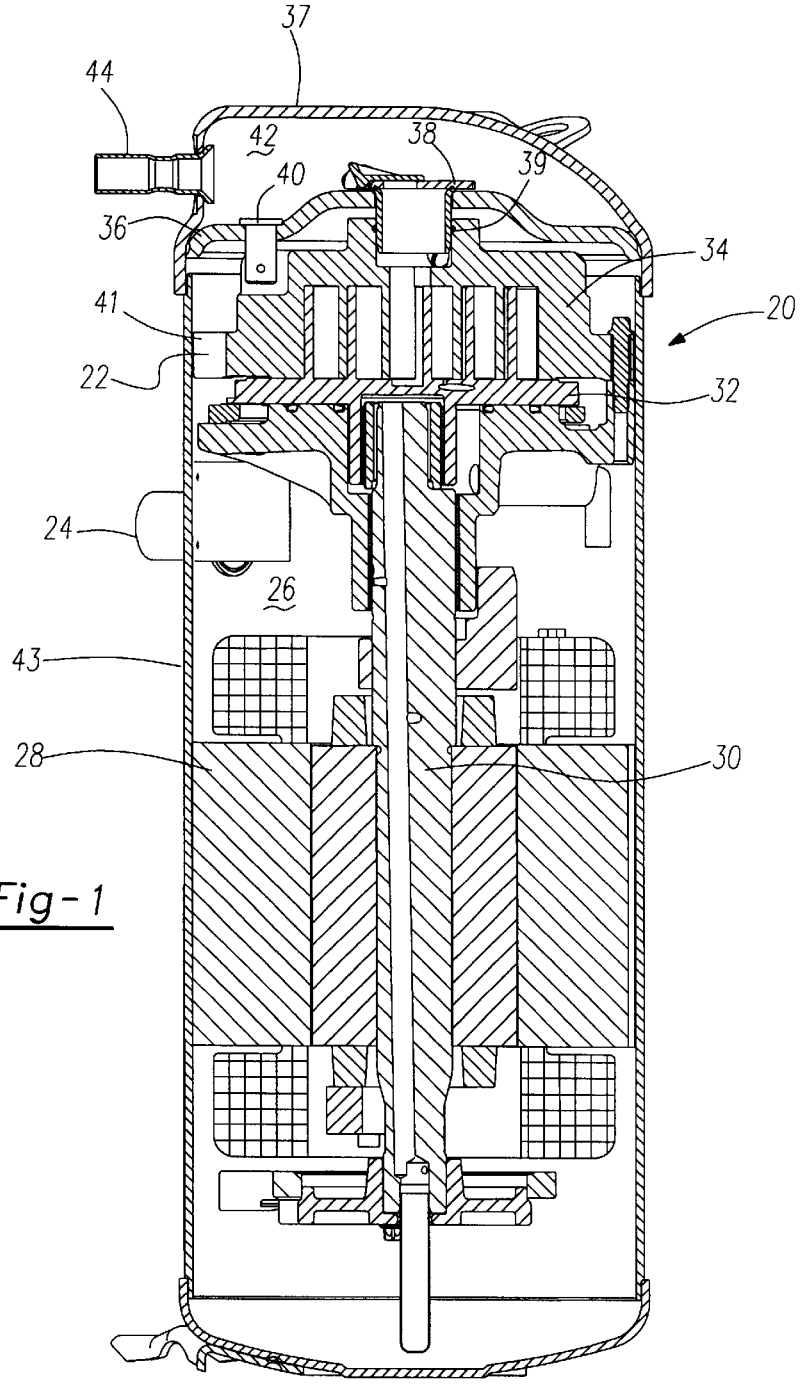
FIG. 1 is a cross-sectional view of a compressor incorporating the present invention.

FIG. 1 shows a scroll compressor 20 incorporating a compressor pump unit 22 and a suction tube 24. The suction tube 24 delivers a refrigerant into an interior chamber 26 which is thus maintained at suction pressure. The motor 28 is received in the chamber 26 and suction pressure fluid cools the motor. A shaft 30 is driven by the motor 28, and causes a scroll member 32 to orbit relative to a non-orbiting scroll member 34.

A separator plate 36 carries a discharge valve assembly 38 and tube 39. The separator plate 36 also receives a pressure relief valve 40. A suction passage 41 carries the refrigerant from the chamber 26 or the inlet 24 to compression chambers between the orbiting 32 and non-orbiting scroll members 34. When the pressure in a discharge pressure plenum 42 exceeds a predetermined amount, then the pressure relief valve 40 opens and refrigerant can move from chamber 42 downwardly into passage 41.

The present invention is directed to a way of assembling the components 36, 38, 39 and 40.

The compressor as described to this point is enclosed in a housing defined by a center shell 43, which is preferably cylindrical, and an end cap 37, which is secured to an end of the shell 43. A discharge tube 44 directs fluid to a downstream location from the chamber 42.

The separator plate 36 is preferably interference fit into the end cap 37. Thus, no expensive and potentially messy welding operation need occur. The pressure relief valve 40 is preferably interference fit into the separator plate 36. Further, the valve assembly 38 is attached to the separator plate 36 by the tube 39 being force-fit within the separator plate 36.

Figure 2:
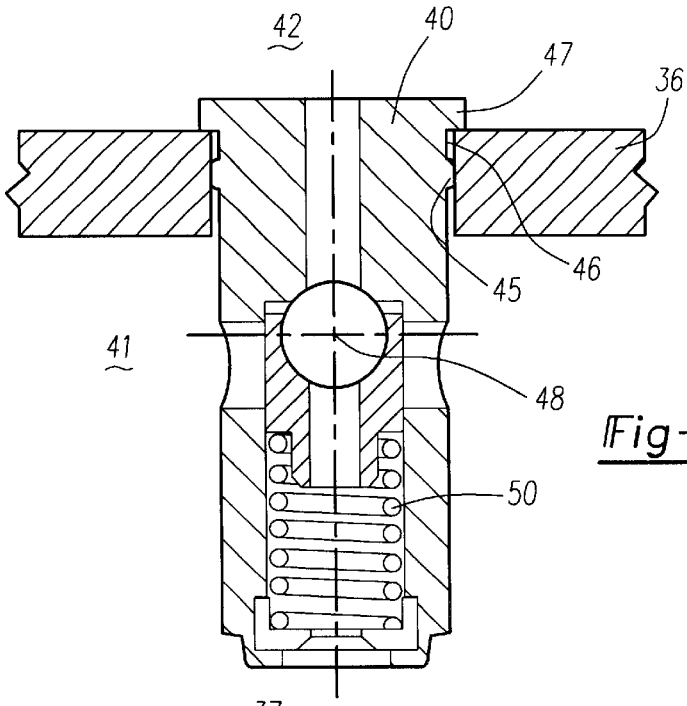
FIG. 2 shows a portion of the invention.

As shown in FIG. 2, the pressure relief valve 40 incorporates an enlarged portion 45 received within an opening 46 in the separator plate 36. Enlarged portion 45 extends over a limited length that is less than the length of said opening 46. A shoulder 47 abuts an upper surface of the plate 36. A spring-loaded valve 48 is biased by a spring 50 to a closed position. As known, if the pressure in chamber 42 exceeds a predetermined amount, then the force of the spring 50 will be overcome and refrigerant can move from chamber 42 to passage 41. By utilizing the force-fit pressure relief valve, the complexity of assembling the scroll compressor is greatly reduced.

Figure 3:
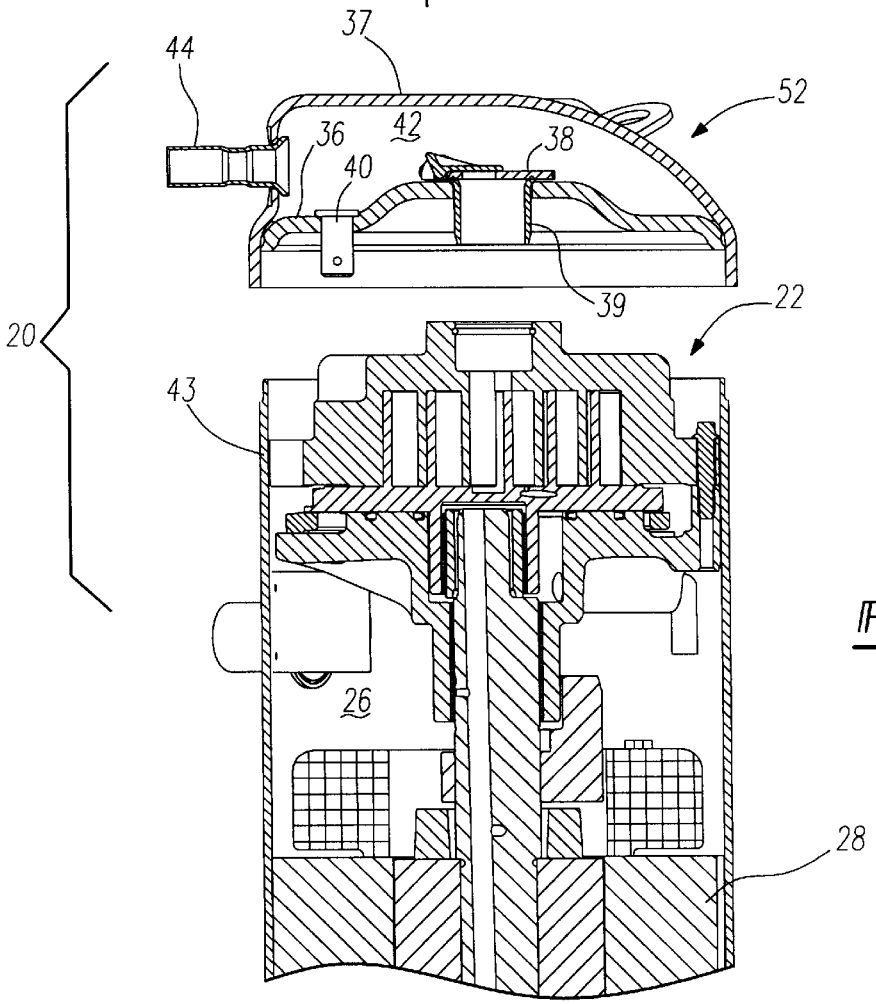
FIG. 3 shows a subassembly according to the present invention.

FIG. 3 shows a subassembly wherein the end cap 37 has not yet been secured to the center shell 43. The separator plate 36 is interference fit upwardly into the end cap 37. As can be appreciated, the outer periphery of the separator plate 36 is sized to be somewhat larger than the inner periphery of the end cap 37. Thus, when the separator plate 36 is forced upwardly into the end cap, it will be retained. As described above, the pressure relief valve 40 is force-fit into the separator plate 36, as is the tube 39 prior to the separator plate 36 being forced into the end cap 37. This subassembly 52 may then be attached to the center shell 39. End cap 37 is then preferably welded to center shell 39.

Figure 4:
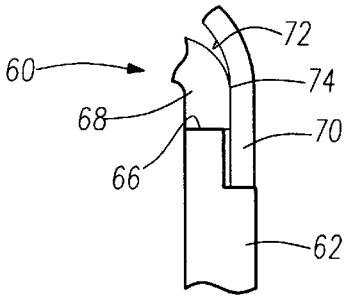
FIG. 4 shows an alternative embodiment.

FIG. 4 shows an alternative embodiment 60. In alternative embodiment 60, the center shell 62 has a lower ledge 64 and an upper ledge 66. The separator plate 68 rests upon the upper ledge 66. The end cap 70 has an inner diameter 72 which is sized such that the separator plate 68 is force or interference fit into the end cap at 74. In the embodiment shown in FIG. 3, the dimensions between the outer diameter of the separator plate and the inner diameter of the end cap are sufficiently large such that once the separator plate has been forced into the end cap, little or no movement of the separator plate should occur. In this embodiment, the difference is less such that the separator plate may be moveable relative to the end cap. However, the area 74 is sized to be sufficient to provide a fluid tight seal preventing leakage of fluid from the discharge plenum into the inlet plenum. In this embodiment, the separator plate will be able to move relative to the end cap to reach a desired position by abutting the upper ledge 66. Discharge pressure above the separator plate urges it downwardly.

The present invention thus simplifies the manufacture and assembly of a scroll compressor by force-fitting several components. In addition to eliminating threading operations and the need for the relief valve to be threaded, the invention also eliminates a number of welding operations. Welding operations are particularly undesirable in the compressor area as weld splatter may lead to noise during operation of the compressor.

Although a preferred embodiment has been disclosed, a worker of ordinary skill in this art would recognize that certain modifications would come within the scope of this invention. For that reason, the following claims should be studied to determine the true scope and content.

What is claimed is:

1. A scroll compressor comprising:

a first scroll member having a base and a generally spiral wrap extending from said base;

a second scroll member having a base and a generally spiral wrap extending from said base;

a shaft driven by a motor, said shaft causing said second scroll member to orbit relative to said first scroll member;

a housing including a center shell surrounding said motor and said first and second scroll members;

an end cap attached to said center shell at an end adjacent said first and second scroll members;

a separator plate mounted between said end cap and said first scroll member;

a suction tube for providing suction pressure gas into an interior chamber receiving said motor, and leading to a passage such that suction pressure gas can enter compression chambers defined between said spiral wraps of said first and second scroll members, a discharge outlet extending from said compression chambers through said first scroll member, and through a discharge tube into a discharge plenum, said separator plate separating said housing into said discharge plenum and said interior chamber, and preventing gas from moving from said discharge plenum into said interior chamber, and said separator plate being interference fit into said end cap; and a pressure release valve also being interference fit into said separator plate and providing communication between said discharge plenum and said interior chamber when a gas pressure in said discharge plenum exceeds a predetermined maximum.

2. A scroll compressor as recited in claim 1, wherein said discharge tube is interference fit into said separator plate.

3. A scroll compressor as recited in claim 1, wherein said interference fit is sufficient to hold said separator plate fixed relative to said end cap.

4. A scroll compressor comprising:

a first scroll member having a base and a generally spiral wrap extending from said base;

a second scroll member having a base and a generally spiral wrap extending from said base;

a shaft driven by a motor, said shaft causing said second scroll member to orbit relative to said first scroll member;

a housing including a center shell surrounding said motor and said first and second scroll members;

an end cap attached to said center shell at an end adjacent said first and second scroll members;

a separator plate mounted between said end cap and said first scroll member;

a suction tube for providing suction pressure gas into an interior chamber receiving said motor, and leading to a passage such that suction pressure gas can enter compression chambers defined between said spiral wraps of said first and second scroll members, a discharge outlet extending from said compression chambers through said first scroll member, and through a discharge tube into a discharge plenum, said separator plate separating said housing into said discharge plenum and said interior chamber, and preventing gas from moving from said discharge plenum into said interior chamber, and said separator plate being interference fit into said end cap; and said interference fit between said separator plate and said end cap, is sufficiently small, that said separator plate is able to move relative to said end cap and rests upon a surface of said center shell.

5. A scroll compressor comprising:

a first scroll member having a base and a generally spiral wrap extending from said base;

a second scroll member having a base and a generally spiral wrap extending from said base;

a shaft driven by a motor, said shaft causing said second scroll member to orbit relative to said first scroll member;

a housing including a center shell surrounding said motor and said first and second scroll members;

an end cap attached to said center shell at an end adjacent said first and second scroll members;

a separator plate mounted between said end cap and said first scroll member; and a suction tube for providing suction pressure gas into an interior chamber receiving said motor, and leading to a passage such that suction pressure gas can enter compression chambers defined between said spiral wraps of said first and second scroll members, a discharge outlet extending from said compression chambers through said first scroll member, and through a discharge tube into a discharge plenum, said separator plate separating said housing into said discharge plenum and said interior chamber, and preventing gas from moving from said discharge plenum into said interior chamber, and a pressure relief valve mounted in said separator plate, said pressure relief valve communicating said discharge plenum to said interior chamber, and said pressure relief valve being interference fit into said separator plate.

6. A scroll compressor as recited in claim 5, wherein said pressure relief valve has an enlarged portion over a limited length, said enlarged portion being interference fit into a bore in said separator plate, said bore extending for an axial length that is longer than an axial length of said enlarged portion.

7. A scroll compressor as recited in claim 6, wherein said relief valve includes an enlarged shoulder portion, said enlarged shoulder portion having a radially outer diameter which is greater than a radially inner diameter of said bore, such that said shoulder abuts an upper face of said separator plate when said pressure relief valve is force-fit into said bore.

8. A scroll compressor comprising:

a first scroll member having a base and a generally spiral wrap extending from said base;

a second scroll member having a base and a generally spiral wrap extending from said base;

a shaft driven by a motor, said shaft causing said second scroll member to orbit relative to said first scroll member;

a housing including a center shell surrounding said motor and said first and second scroll members;

an end cap attached to said center shell at an end adjacent said first and second scroll members;

a separator plate mounted between said end cap and said first scroll member; and a suction tube for providing suction pressure gas into an interior chamber receiving said motor, and leading to a passage such that suction pressure gas can enter compression chambers defined between said spiral wraps of said first and second scroll members, a discharge outlet extending from said compression chambers through said first scroll member, and through a discharge tube into a discharge plenum, said separator plate separating said housing into said discharge plenum and said interior chamber, and preventing gas from moving from said discharge plenum into said interior chamber, and a pressure relief valve mounted in said separator plate, said pressure relief valve communicating said discharge plenum to said interior chamber, said pressure relief valve and said discharge tube being interference fit into said separator plate.

* * * * *